US006930445B2

(12) United States Patent
Bucher

(10) Patent No.: US 6,930,445 B2
(45) Date of Patent: Aug. 16, 2005

(54) COMPLIANT TENSION MASK ASSEMBLY

(75) Inventor: Alan Weir Bucher, Manheim, PA (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 105 days.

(21) Appl. No.: 10/466,257

(22) PCT Filed: Jan. 16, 2002

(86) PCT No.: PCT/US02/01053

§ 371 (c)(1),
(2), (4) Date: Jul. 15, 2003

(87) PCT Pub. No.: WO02/058098

PCT Pub. Date: Jul. 25, 2002

(65) Prior Publication Data

US 2004/0066130 A1 Apr. 8, 2004

(51) Int. Cl.[7] ..... H01J 29/07
(52) U.S. Cl. ..... 313/407; 313/402
(58) Field of Search ..... 313/402–408; 445/30, 37, 47

(56) References Cited

U.S. PATENT DOCUMENTS 5,681,197 A 10/1997 Egami et al. ..... 445/30
6,512,326 B1 * 1/2003 Arai et al. ..... 313/407
6,731,055 B2 * 5/2004 Reed et al. ..... 313/407
6,734,611 B2 * 5/2004 Bucher ..... 313/407

FOREIGN PATENT DOCUMENTS

JP 2000-231888 8/2000 ..... H01J/29/07
WO 00/60636 10/2000 ..... H01J/29/07

OTHER PUBLICATIONS

Patent Abstracts of Japan, vol. 2000, No. 11, Jan. 3, 2001 & JP 2000–231888.
Copy of Search Report dated Jun. 11, 2002.

* cited by examiner

*Primary Examiner*—Karabi Guharay
(74) *Attorney, Agent, or Firm*—Joseph S. Tripoli; Harvey D. Fried; Richard LaPeruta, Jr.

(57) ABSTRACT

A color picture tube has a compliant tension mask frame assembly mounted within said tube. The tension mask frame assembly includes a peripheral frame including opposing side support frame members and a pair of parallel intermediate members. Each of the intermediate members is attached to the peripheral frame at a single location and the mask is attached to longitudinal edges of the intermediate members. Further included are clips that serve as guides for holding the intermediate members to the frame while permitting expansion of the frame relative to the intermediate members and permitting compliance.

8 Claims, 5 Drawing Sheets

COMPLIANT TENSION MASK ASSEMBLY

This application claims the benefit, under 35 U.S.C. § 365 of International Application PCT/US02/01053, filed Jan. 16, 2002, which was published in accordance with PCT Article 21(2) on Jul. 25, 2002 in English and which claims the benefit of U.S. patent application Ser. No. 60/262,765, filed Jan. 20, 2001.

This invention relates to color picture tubes having tension masks, and particularly to a tension mask assembly having means for connecting a tension mask to a support frame to improve compliance.

BACKGROUND OF THE INVENTION

A color picture tube includes an electron gun for generating and directing three electron beams to the screen of the tube. The screen is located on the inner surface of a faceplate of the tube and is made up of an array of elements of three different color emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask affixed to two parallel support frame members under tension and mounted within a faceplate panel thereof. The tension assists in controlling vibration, or microphonics, of the mask during tube operation. During the manufacturing of the CRT, the mask and frame are passed through a furnace and heated to very high temperatures thereby causing the frame and mask to expand. During this heating cycle, the mask and frame materials lose strength and deform beyond their plasticity limits. When the mask and frame are cooled thereafter the tension on the mask is reduced by approximately the ratio of the total plastic deformation to the original compliance. Conventional frame designs have high center compliance but very low edge compliance. The low edge compliance provides little reserve for tension control at the edges of the mask. The compliance pattern of the conventional frame results in mask deformation which can wrinkle the mask. In order to maintain the tension on the mask in a conventional tension mask frame, the mask must be attached to a relatively massive support frame. It has been suggested that a lighter frame could be used in a tension mask tube if the required tension on a mask is reduced. One way to reduce the required mask tension is to make the mask from a material having a low coefficient of thermal expansion. However, a mask from such material would require a support frame of a material having a similar coefficient of thermal expansion, to prevent any mismatch of expansions during thermal processing that is required for tube manufacturing. Because the metal materials that have low coefficients of thermal expansion are relatively expensive, it is relatively costly to make both the mask and frame out of identical or similar low expansion materials. Therefore, it is desirable to use the combination of a low expansion tension mask with a higher expansion support frame, and to provide a solution to the problem that exists when there is a substantial mismatch in coefficients of thermal expansion between a tension mask and its support frame. It is also desirable to provide a means for modifying the pattern of compliance of the mask frame to control tension on the mask lost through thermal processing and to prevent wrinkling of the mask.

SUMMARY OF THE INVENTION

The present invention provides an improvement in a color picture tube having a compliant tension mask frame assembly mounted within the tube. The tension mask frame assembly includes a peripheral frame having opposing side support frame members and a pair of parallel intermediate members. Each intermediate member is attached to a side member at a single location between the distal ends of the intermediate members. The mask is held in tension by the intermediate members which provide means for higher edge compliance relative to the compliance in the center of the frame. Such a compliance pattern allows avoidance of wrinkles without losing an unacceptable amount of tension.

The present invention further provides means of using materials having different coefficients of thermal expansion. In such case, the intermediate members can be of a material similar to that of the mask having a first coefficient of thermal expansion and the peripheral frame can be constructed of a material having second coefficient of thermal expansion. For example, the tension mask and intermediate members can be constructed out of Invar or similar material that has a relatively low coefficient of thermal expansion to that of the material used to form the peripheral frame. In an additional embodiment, the peripheral frame includes clips which serve as guides to hold the intermediate members to the frame, while permitting expansion of the frame relative to the intermediate members and preventing any undesirable distortion of the intermediate members.

DETAILED DESCRIPTION OF THE PREFERRED EMBODIMENTS

Figure 1:
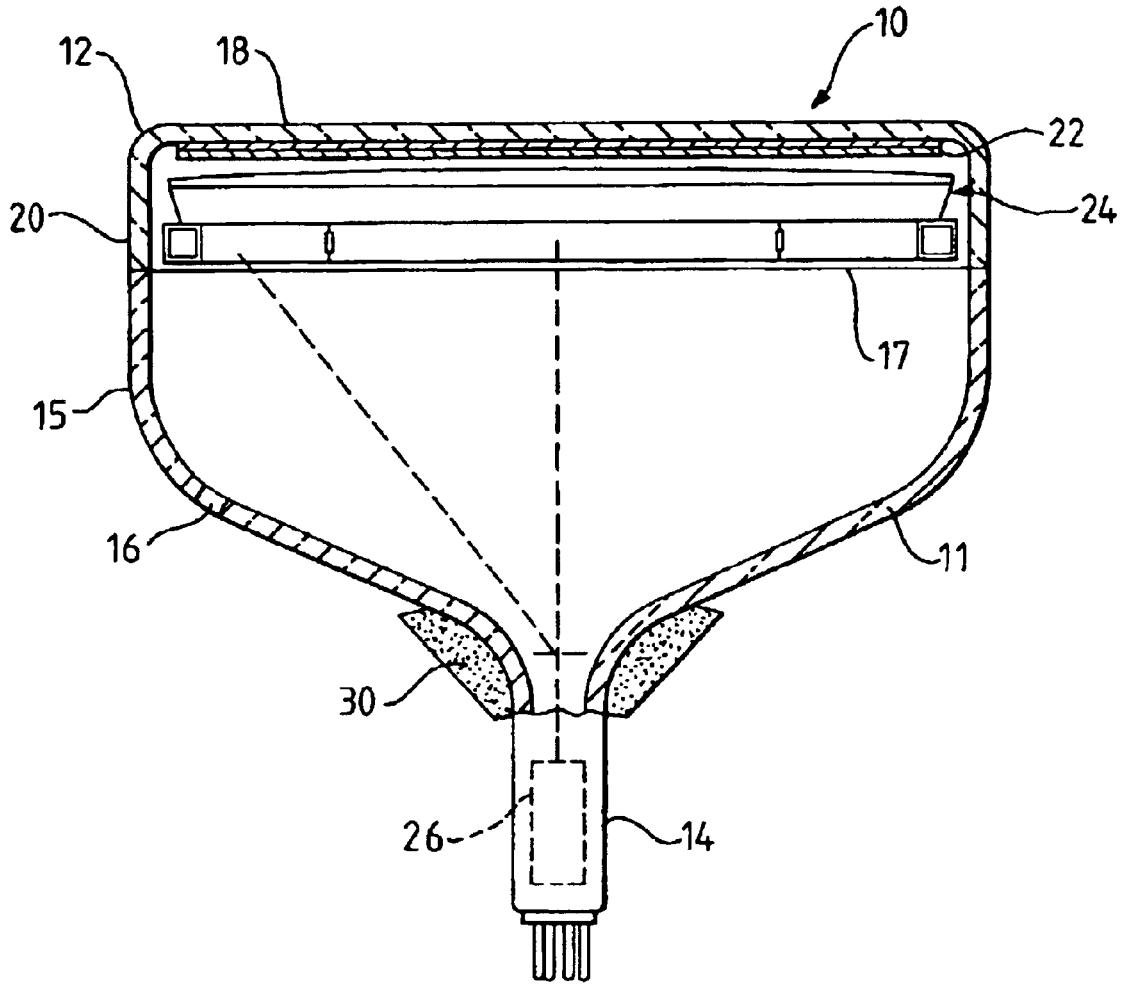
FIG. 1 is a side view, partly in axial section, of a color picture tube embodying the invention.

FIG. 1 shows a color picture tube 10 having a glass envelope 11 comprising a rectangular faceplate panel 12 and a tubular neck 14 connected by a funnel 15. The funnel 15 has an internal conductive coating (not shown) that extends from an anode button 16 toward the panel 12 and to the neck 14. The panel 12 comprises a substantially cylindrical viewing faceplate 18 and a peripheral flange or sidewall 20, which is sealed to the funnel 15 by a glass frit 17. A three-color phosphor screen 22 is carried by the inner surface of the faceplate 18.

The screen 22 is a line screen with the phosphor lines arranged in triads, each triad including a phosphor line of each of the three colors. A tension mask frame assembly 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the tension mask frame assembly 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
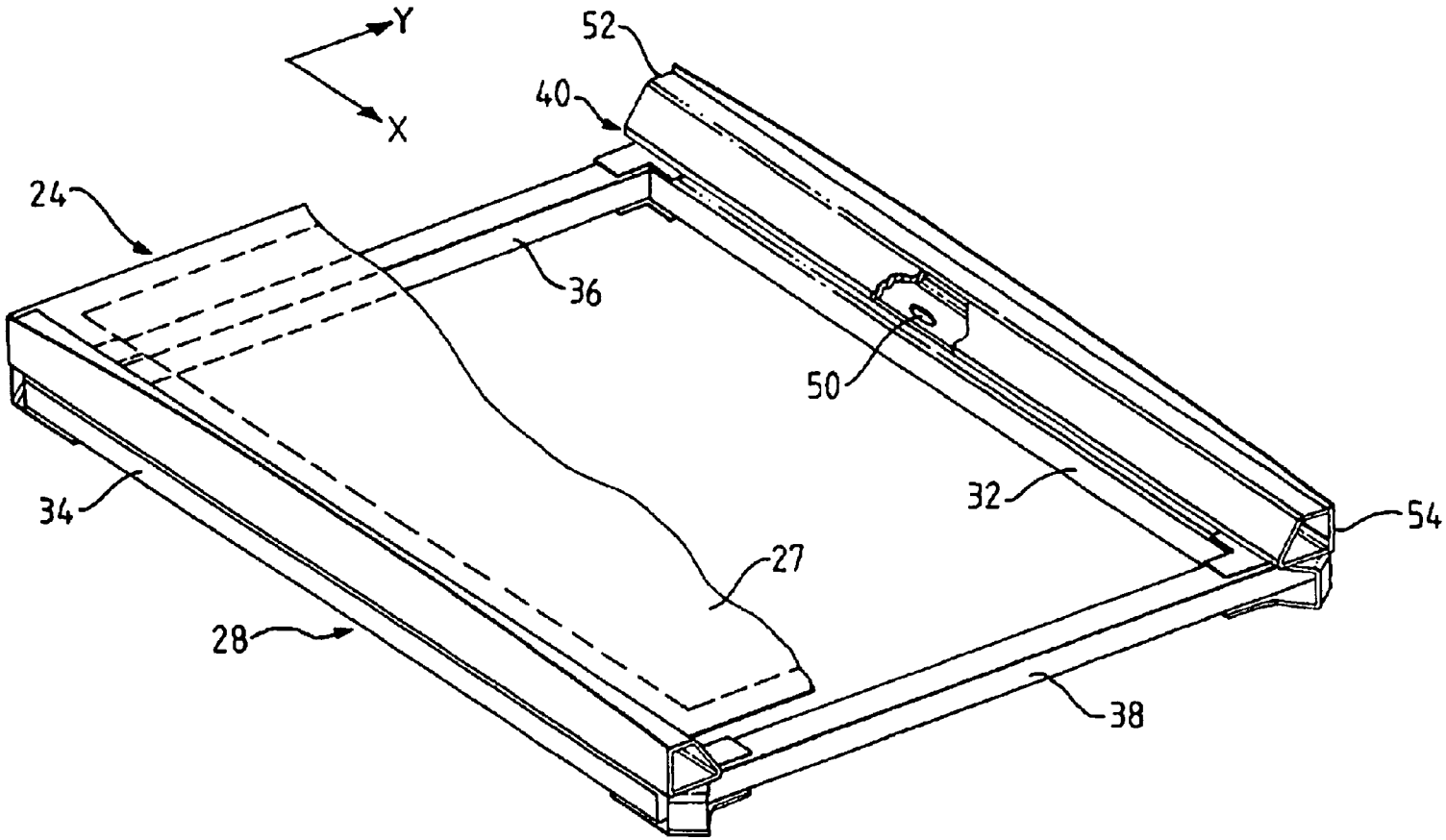
FIG. 2 is a perspective view of a tension mask-frame assembly.

The tension mask frame assembly 24, as shown in FIG. 2, includes a peripheral frame 28 that includes two opposed long side support frame members 32 and 34, and two opposed short side support frame members 36 and 38. The two long side support frame members 32 and 34 of the frame parallel a central major axis, X, of the tube; and the two short sides 36 and 38 parallel a central minor axis, Y, of the tube. The tension mask frame assembly 24 further includes an apertured mask 27 and a pair opposed intermediate members 40. The intermediate member 40 may vary in height from the center of each section longitudinally to the ends of the sections to permit the best curvature and tension compliance over the mask.

Each intermediate member 40 extends the length of a long side support frame member, 32 and 34. The intermediate members 40 are welded to the peripheral frame 28 at a single location 50 on the long sides support frame members, 32 and 34. The tension mask 27 is welded along the longitudinal upper distal edges of the two parallel intermediate members 40. The intermediate members 40 may be constructed of a material that has a coefficient of thermal expansion similar to that of the mask 27. Therefore, changes of temperature will have little effect on the position of the mask 27 relative to the intermediate members 40.

Figure 3:
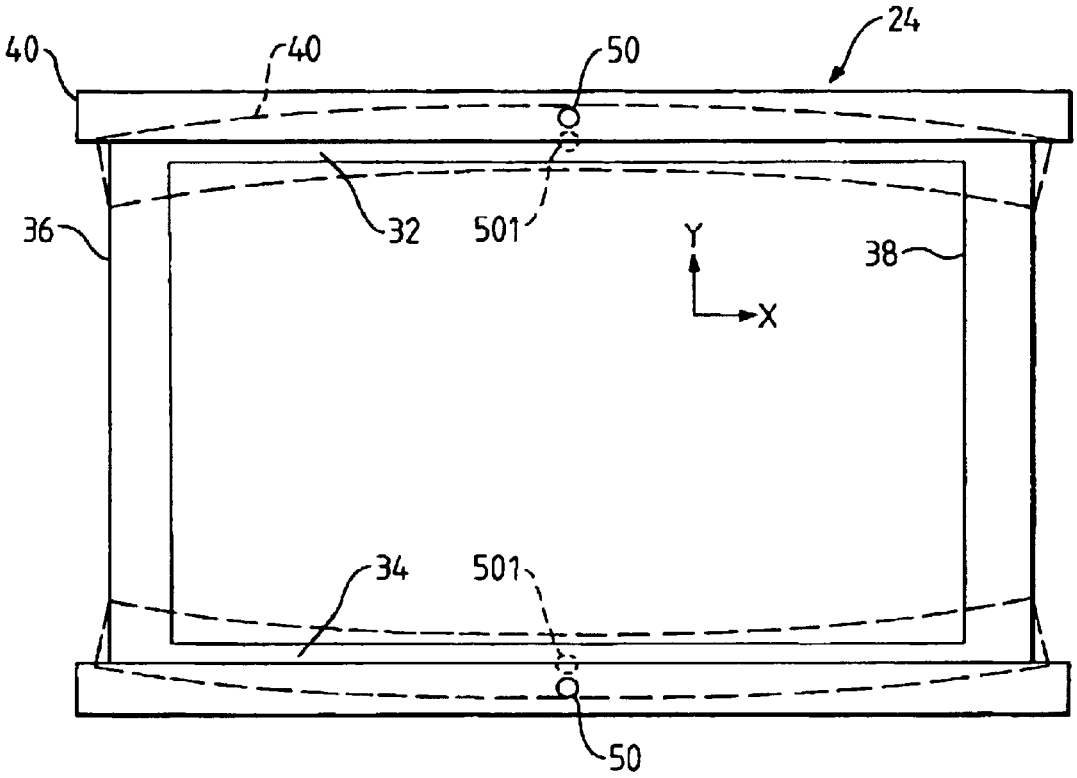
FIG. 3 is a plan view of the mask frame assembly with the tension mask removed for clarity and illustrating the compliance of the intermediate members.

FIG. 3 is an illustration showing, in dashed lines, the compliance of the intermediate members 40 supporting a tension mask (not shown). The attachment point at central location 50 is also shown (as 501) at positions where the long side support frame member 32 and 34 deform under the tension load of the mask (not shown).

Figure 4:
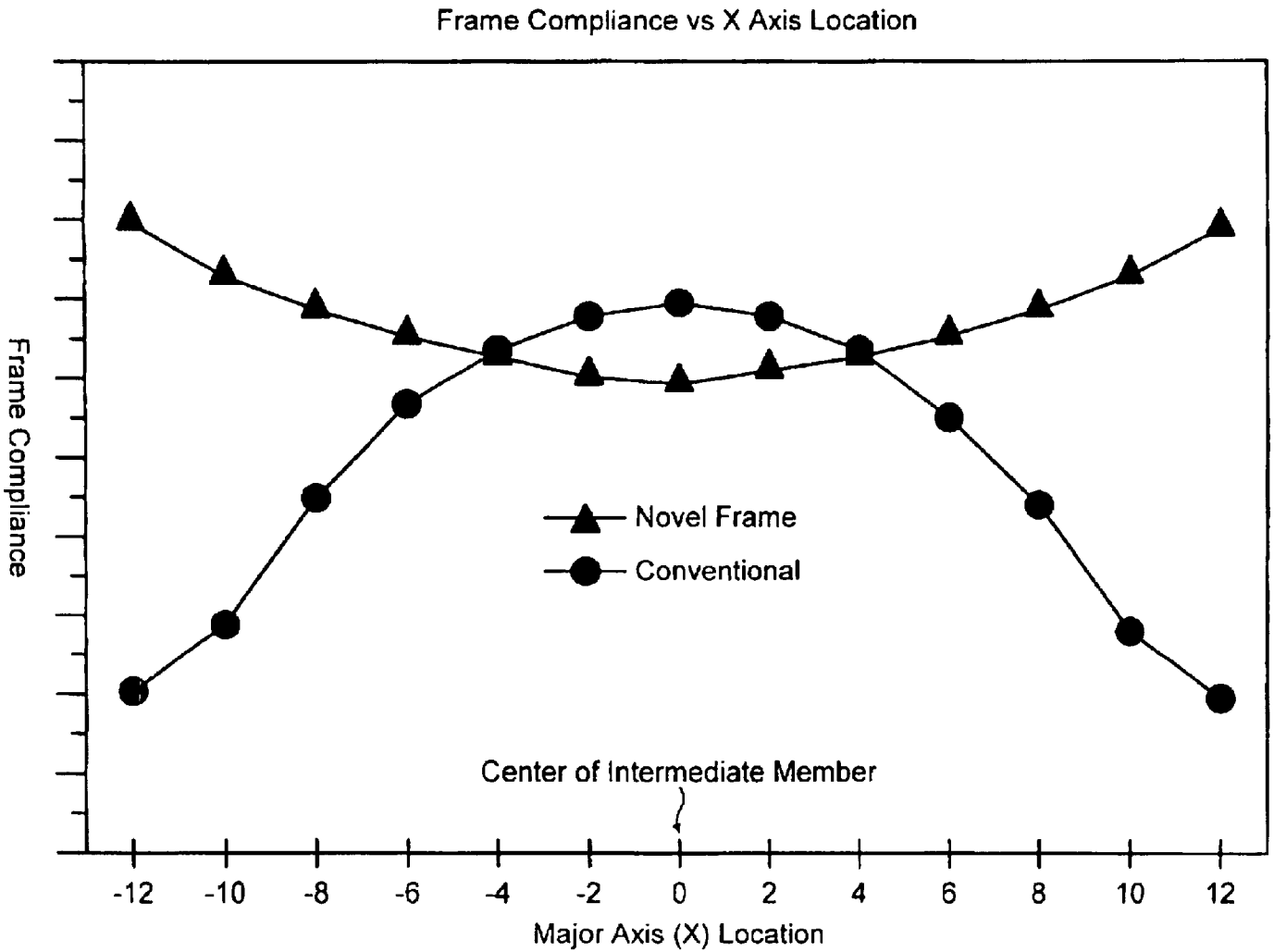
FIG. 4 is an explanatory diagram showing compliance distribution according to the present invention.

FIG. 4 is a compliance graph showing a relationship between a conventional mask flame assembly compliance pattern and the compliance associated with the mask frame assembly of the present novel invention. More specifically, the graph shown in FIG. 4 illustrates the compliance characteristic at the distal ends 52 and 54 (as shown in FIG. 2) of the intermediate members 40 of the present invention. Attachment of the intermediate members 40 only at one point permits ends 52 and 54 to deflect free from the outer edges of the peripheral flame 28. Specifically, since the ends of the intermediate members 40 are not attached to the peripheral frame 28, the intermediate members 40 provide increased compliance at the edge of the tension mask.

Figure 5:
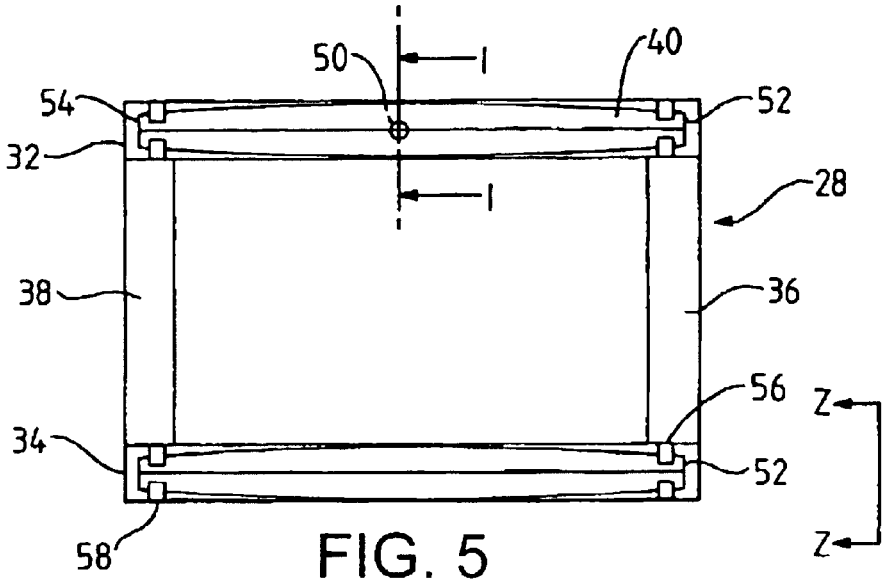
FIG. 5 is a plan view of an alternative embodiment of the present invention.
Figure 6:
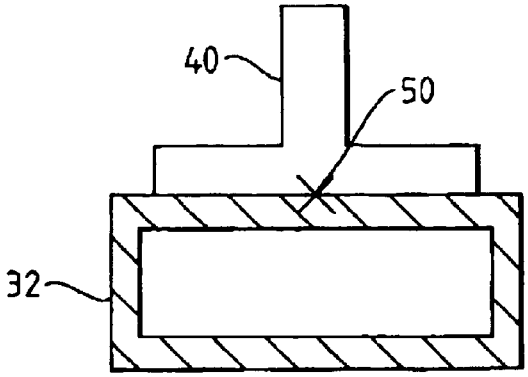
FIG. 6 shows a view of the embodiment in FIG. 5 along line 1—1.
Figure 7:
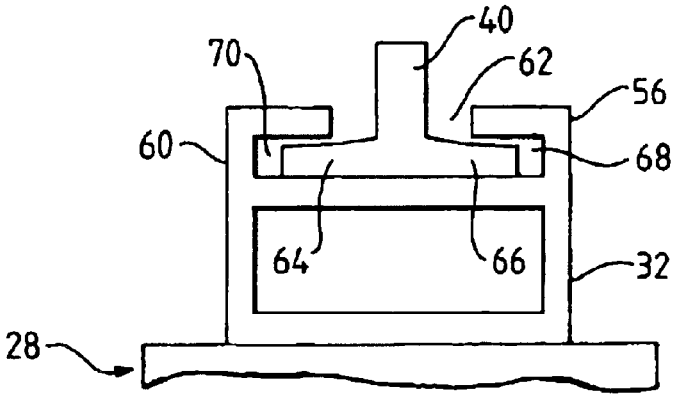
FIG. 7 shows a view of the embodiment in FIG. 5 along line 2—2.

In an alternate embodiment shown in FIGS. 5–7, the intermediate member 40 has a generally T-shape cross section with the two distal ends, 52 and 54 held by two clips, 56 and 58, respectively, having an upwardly opening channel portion 60 and longitudinal extending slot 62. The intermediate member 40 includes inner guide elements 64 and 66 disposed within said channel portion 60 and slot 62. The T-shaped intermediate members are longitudinally spaced relative to the clips 56 and 58 so as to define internal cavities 68 and 70 within which the inner guide elements 64 and 66 of the intermediate member 40 is vertically slidably supported so as to serve as guides that hold the intermediate member 40 to prevent rotation of the member near its end, while permitting longitudinal movement of the intermediate member 40, caused by its expansion during tube operation, relative to the peripheral frame 28. The clips 56 and 58 either may be formed by cutouts extending from the peripheral flame 28, or may be separate parts that are secured to the frame.

An advantage of the present invention is that the tension mask frame assembly allows for increased compliance at the edges of the mask. This increased edge compliance and improved compliance distribution allows the frame to reliably control tension and prevent wrinkles in the mask, thus improving efficiency in the manufacturing process. In addition, the present invention provides the means for using materials for the mask and frame with significantly different coefficients of thermal expansion.

Many other embodiments are possible within the scope and spirit of the invention. For example, although the long side and short side support frame members have been shown as hollow square tubes, other preferred configurations, such as those having L-shaped, C-shaped or triangular-shaped cross-sections, are also possible for these sections. It is, therefore, intended that the foregoing description be regarded as illustrative rather than limiting, and that the scope of the invention is given by the appended claims together with their full range of equivalents.

What is claimed is:

1. A color picture tube having a compliant tension mask frame assembly mounted within said tube, comprising:

a peripheral frame having opposing side support frame members and a pair of parallel intermediate members, each intermediate member having a generally T-shaped cross section and being attached to the frame at a single location between the distal ends of the intermediate member; and, a mask attached to the intermediate members whereby the mask is held in tension between the intermediate members.

2. The color picture tube as defined in claim 1, wherein peripheral frame farther comprises two opposed long side members and two opposed short side support frame members wherein the intermediate members are attached, to at least one pair of the two opposed side members.

3. The color picture tube as defined in claim 1, further comprising clips near the distal ends of the intermediate members.

4. The color picture tube of claim 3, wherein the generally T-shaped intermediate member comprises a cross piece forming two guide elements which are slidably supported within the clips.

5. The color picture tube of claim 4, wherein the clips comprise an upwardly open channel retaining the guide elements and a longitudinal extending slot receiving a base of the generally T-shaped intermediate member.

6. The color picture tube of claim 3, wherein the clips are integral with the peripheral frame.

7. The color picture tube as defined in claim 1, wherein the mask and the intermediate members are made from a material having a first coefficient of thermal expansion and the peripheral frame is made from a material having a second coefficient of thermal expansion.

8. The color picture tube as defined in claim 7, wherein the first coefficient of thermal expansion is relatively lower than the second coefficient of thermal expansion.

* * * * *